US007137655B2

(12) United States Patent
Quarberg

(10) Patent No.: US 7,137,655 B2
(45) Date of Patent: Nov. 21, 2006

(54) DOOR SECURITY BRACE

(76) Inventor: Craig D. Quarberg, 1201 Golf Course Rd., Monticello, MN (US) 55362

( * ) Notice: Subject to any disclaimer, the term of this patent is extended or adjusted under 35 U.S.C. 154(b) by 100 days.

(21) Appl. No.: 10/823,137

(22) Filed: Apr. 13, 2004

(65) Prior Publication Data

US 2005/0225099 A1 Oct. 13, 2005

(51) Int. Cl.
*E05C 17/54* (2006.01)
*E05F 5/02* (2006.01)
*A47F 5/00* (2006.01)

(52) U.S. Cl. ..... 292/339; 292/338; 292/DIG. 15; 16/82; 248/351; 248/354

(58) Field of Classification Search ..... 292/339, 292/DIG. 15, 338; 16/82, 83, DIG. 20; 70/14, 70/94; D8/339; 52/127.1, 127.2; 248/351, 248/354.1, 354.5, 357
See application file for complete search history.

(56) References Cited

U.S. PATENT DOCUMENTS 392,133 A * 10/1888 Peck ..... 292/73
561,373 A * 6/1896 Campbell ..... 292/5
1,304,394 A * 5/1919 Shyer ..... 292/338
2,330,105 A * 9/1943 Barrows ..... 248/351
2,774,622 A * 12/1956 Priebe ..... 292/288

(Continued)

FOREIGN PATENT DOCUMENTS

GB 2102495 * 2/1983

*Primary Examiner*—Brian E. Glessner
*Assistant Examiner*—Carlos Lugo
(74) *Attorney, Agent, or Firm*—Nikolai & Mersereau, P.A.; Thomas J. Nikolai

(57) ABSTRACT

A security brace for impeding forced entry into a room through an entry door. The brace comprises a plurality of elongated pole members with foot members secured at a first end of the pole member, and a block member operatively coupled to a second end of the pole members. The block member has a top planar surface with a yoke projecting upward from the top planar surface. The yoke is adapted to receive the shaft of a door knob lock set. When an uninvited intruder applies force to open the entry door, the force vector is directed down the pole members and holds the foot members against the floor, thus impeding the door from swinging open.

14 Claims, 4 Drawing Sheets

U.S. PATENT DOCUMENTS 3,313,505 A * 4/1967 Petrie ..... 248/165
3,328,065 A * 6/1967 Arenson ..... 292/343
3,583,743 A * 6/1971 Newell ..... 292/339
4,019,765 A * 4/1977 Nichola ..... 292/338
4,036,518 A * 7/1977 Jost ..... 292/339
4,395,065 A * 7/1983 Nelson et al. ..... 292/339
4,483,558 A * 11/1984 Van Meter ..... 292/339
4,563,027 A * 1/1986 Chechovsky et al. ..... 292/339
4,666,195 A * 5/1987 Thomas, III ..... 292/338
4,676,536 A * 6/1987 Arbic et al. ..... 292/339
4,759,577 A * 7/1988 Thomas, III ..... 292/338
4,872,634 A * 10/1989 Gillaspy et al. ..... 248/354.3
4,883,297 A * 11/1989 Smith ..... 292/339
4,971,374 A * 11/1990 Lovell et al. ..... 292/339
5,064,232 A 11/1991 Quarberg ..... 292/339
5,131,701 A * 7/1992 Stepniewski ..... 292/339
5,286,075 A * 2/1994 Monzingo ..... 292/339
5,333,922 A * 8/1994 Jones ..... 292/339
5,544,386 A * 8/1996 Cobb ..... 16/82
5,632,230 A * 5/1997 Dornetta ..... 119/537
5,765,416 A * 6/1998 Cote ..... 70/238
5,787,548 A * 8/1998 Tzen ..... 16/82
5,951,072 A * 9/1999 McElary ..... 292/339
5,988,710 A * 11/1999 Kortschot et al. ..... 292/339
6,159,111 A * 12/2000 Purcell ..... 473/422
6,234,440 B1 * 5/2001 Boney et al. ..... 248/354.1
6,454,323 B1 * 9/2002 Mills ..... 292/339
6,612,533 B1 * 9/2003 Biles et al. ..... 248/354.1
6,820,844 B1 * 11/2004 Tiffen et al. ..... 248/168
6,947,666 B1 * 9/2005 Chapman et al. ..... 396/4

* cited by examiner

DOOR SECURITY BRACE

BACKGROUND OF THE INVENTION

I. Field of the Invention

This invention relates generally to building security devices, and more particularly to a portable bar arrangement designed to prevent a door from being forced open.

II. Discussion of the Prior Art

Security in one's home is a paramount value in today's society. As reflected in films such as "Panic Room", Americans desire to know that they are going to be safe from a violent or criminal invasion of their home. In particular, individuals wish to know that a burglar will not be able to kick in a building's entry door.

Most people rely on conventional locksets to keep invaders out of their home. These locksets typically have a key-operated bolt which is too short relative to its depth of penetration into an adjacent door jam to resist the force of an adult kicking in the door or lunging at the door with his shoulder. With little force, a burglar can crack and shatter a wooden door jams.

In addition to conventional locksets homeowners may deploy a variety of other devices including slide bolts, chains, and other devices which can be overcome using a pry bar or a bolt cutter.

Applicant's U.S. Pat. No. 5,064,232 entitled "Entry Door Security Bar" represented a step forward in overcoming the deficiencies of previous locking mechanisms. The device claimed by the '232 patent comprised a single pole having a footpad at its lower end and a specially designed head member at the upper end of the pole. The head member had a semi-circular grove for receiving a door knob. When the head member received the door knob, and the foot member intersected with the floor, the force vector resulting from someone pushing against the entry door was directed downward which prevented the door from opening. However, as intruders have become stronger, the stress on the bar has become greater. Intruders using a battering ram or other such tools maybe able to overcome the resistance provided by the '232 brace.

SUMMARY OF THE INVENTION

The present invention is a novel and substantial improvement over Applicant's '232 patent. The present invention comprises plurality of pole members for supporting a block member that is adapted to engage a door knob. The plurality of pole members preferably includes at least three such pole members, with a central pole member and two side pole members that are set at a predetermined angle to the vertical. Each pole member has an upper end and a lower end. Each pole member further includes a foot member secured to the lower end. Each foot member includes a non-skid floor engaging surface. The non-skid surface may be an elastomeric pad, that includes a plurality of laterally extending corrugations. The pole members each comprise first and second, tubular, telescoping segments, and a means for locking said segments relative to one another at a predetermined composite length. The telescoping segments allow the brace to be collapsed for easy storage and transportation. The collapsible pole members also allow the brace to be adjusted to adapt to door knobs of various heights from a floor surface.

The block member has a top planar surface with an upwardly extending yoke. The base of the yoke extends perpendicularly from a midpoint of the top planar surface. A head member of the yoke slopes upward at a predetermined angle to the longitudinal axis of the yoke base. The head member has a generally semicircular recess which is adapted to receive the door knob. The block member further includes a bottom surface with a plurality of circular apertures dimensioned to receive the ends of respective pole members therein. When the pole members are at predetermined angles to the floor, and the yoke is engaged with the door knob, the force vector resulting from someone pushing against the door is dispersed and directed downward along the pole members. This dispersal better prevents the footpad from sliding along the floor.

DESCRIPTION OF THE DRAWINGS

The foregoing objects, advantages, and features of the invention will become apparent to those skilled in their from the following detailed description of the preferred embodiment, especially when considered in conjunction with the accompanying drawings in which like numerals in the several views refer to the corresponding parts.

DESCRIPTION OF THE PREFERRED EMBODIMENT

Figure 1:
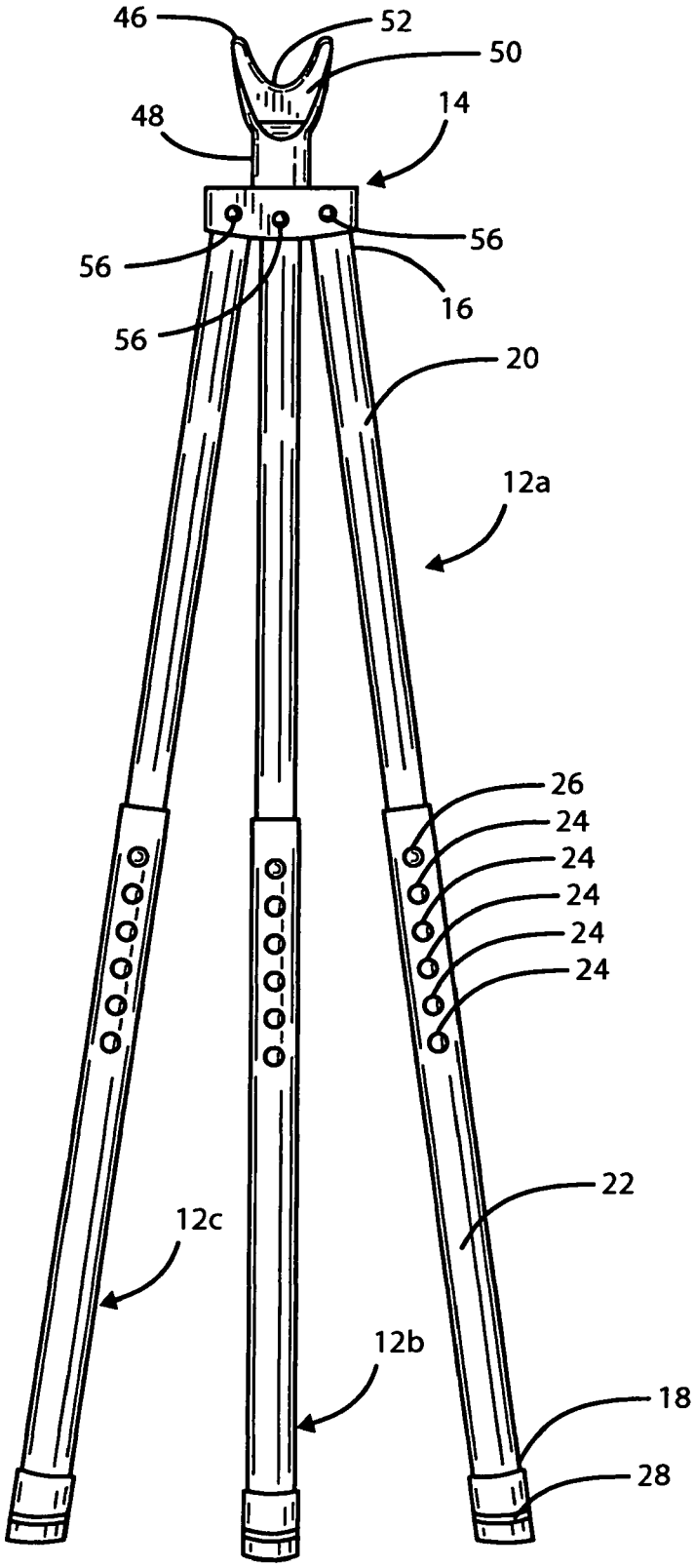
FIG. 1 is a front elevation view of the security brace comprising the preferred embodiment of the present invention.
Figure 2:
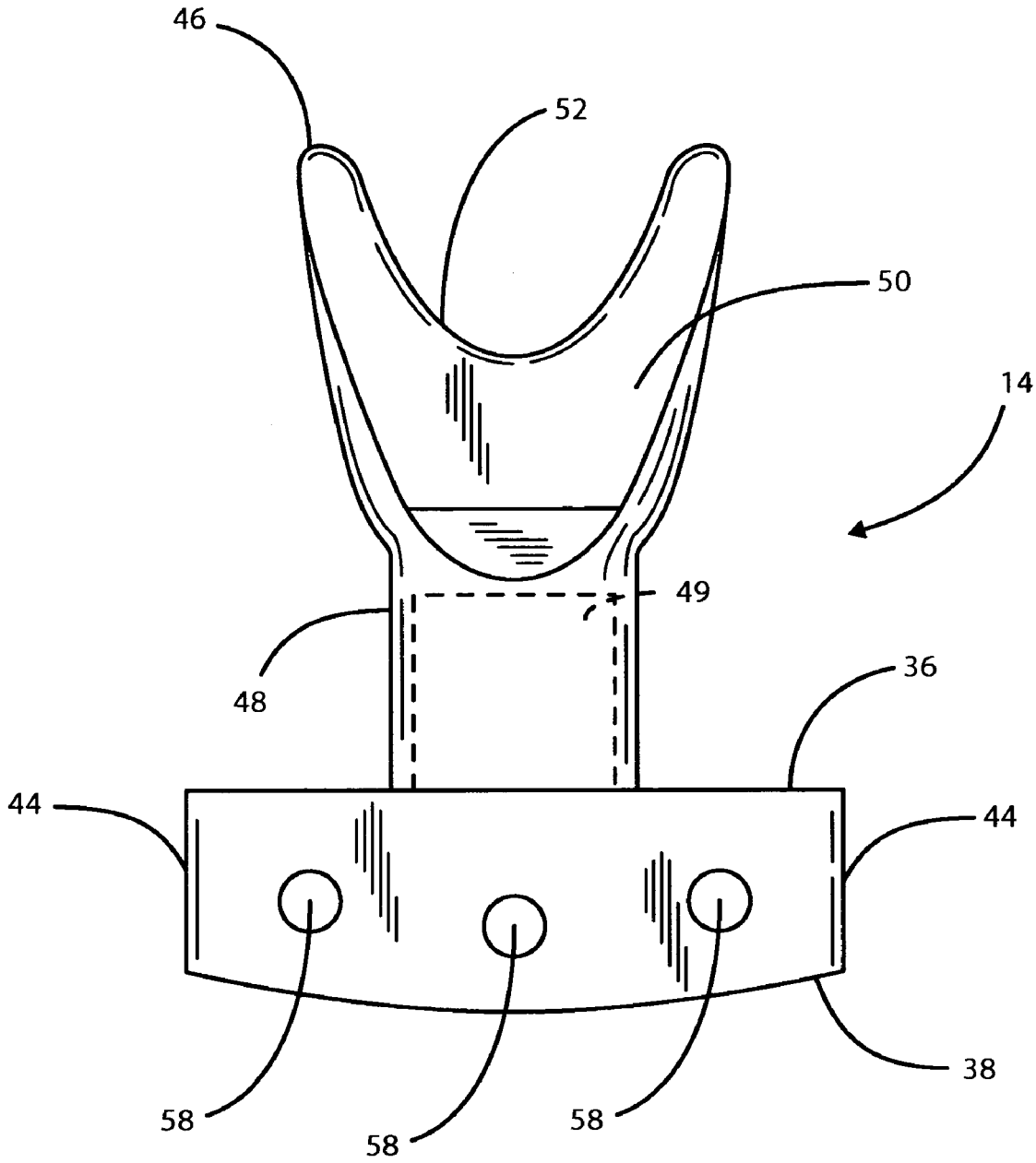
FIG. 2 is a front elevation view of the block member of FIG. 1.

Referring first to FIG. 1, there is indicated generally by numeral 10 an entry door security brace for barring entry into a room through its door. The security brace 10 comprises a plurality of pole members 12*a*, 12*b*, 12*c* and a block member 14. Pole members 12*a*, 12*b*, 12*c* are each identical in composition. Each pole member has an upper end 16 and a lower end 18. The pole members may be solid, but preferably comprise an upper tubular segment 20 and lower tubular segment 22 of generally equal length where the internal diameter of the upper segment 20 and the external diameter of the lower segment 22 are such that the upper segment 20 can telescopically fit within the interior of the lower segment 22. In this way, the device can be collapsed into a more compact length for easy of transportation in a suitcase or the like. When in use, the unit will extend until a bottom detent 26 disposed on a lower portion of the upper segment 20 passes through the aligned aperture 24. This will prevent the pole member from collapsing under a heavy load.

Affixed to the lower end 18 of each pole member 12*a*, 12*b*, 12*c*, is a footpad 28. The footpad 28 comprises an upwardly extending circular socket 30 and a molded plastic base 32 with corrugations 34. The footpad 28 is affixed to the lower end 18 by inserting the lower end 18 into the socket 30. The corrugations 34 engage the floor or carpet fibers to prevent the footpad 28 from slipping or marring a floor surface. The footpad 28 is preferably made of an elastomeric material. The socket 30 is angled with respect to the molded plastic base 32 as such the pole member can be positioned at an angle to the floor while the molded plastic base 32 rests flat on the floor.

Figure 3:
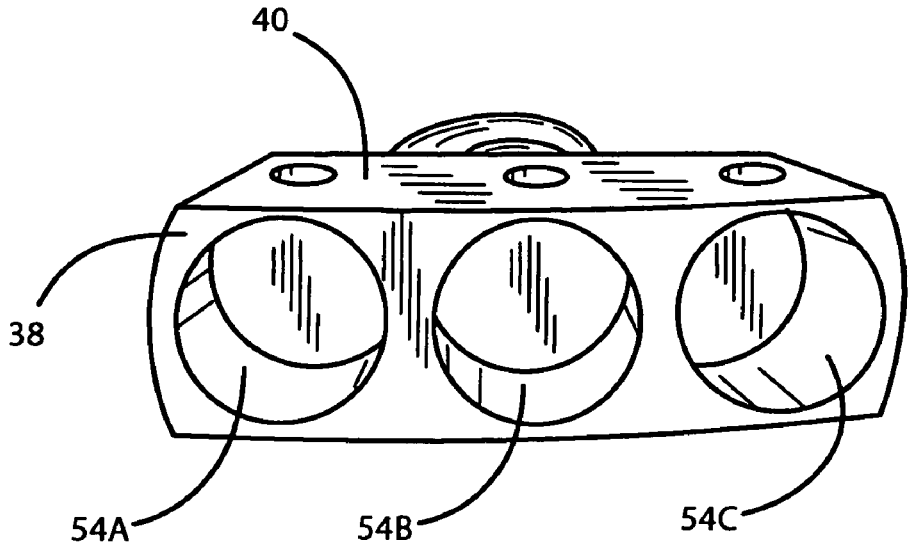
FIG. 3 is a bottom elevation view of the block member of FIG. 1.
Figure 4:
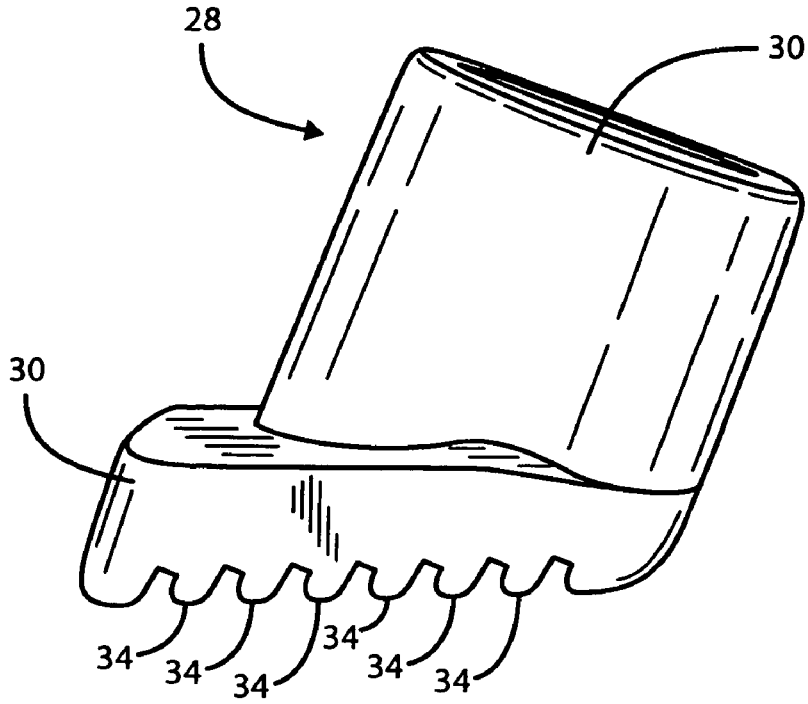
FIG. 4 is a partial view of the footpad of FIG. 1.

The block member 14 has a top planar surface 36, a bottom surface 38, a front and rear surface 40, 42, and a pair of side surfaces 44. An upwardly extending yoke 46 extends at the midpoint of the top planar surface 36. The yoke comprises a rounded tubular yoke base 48 and a head member 50. The yoke base 48 is perpendicular to the top planar surface 36 and fits over a cylindrical stem 49 projecting upward from the surface 36. The head member 50 slopes at a predetermined angle to the longitudinal axis of the yoke base 48. As seen in FIGS. 1 and 3, the head member 50 has a semi circular recess 52 formed through the head member 50.

The bottom surface 38 of the block member 14 includes a plurality of non-intersecting circular apertures 54*a*, 54*b*, 54*c*. An end portion 16 of pole member 12*a* is inserted into circular aperture 54*a*. Likewise, pole member 12*b* is inserted into circular aperture 54*b* and pole member 12*c* is inserted into circular aperture 54*c*. The front surface 40 of the block member 14 has a plurality of front surface apertures 58. Each pole member further includes an upper ball detent 56 disposed proximate its upper end 20. The upper ball detent 56 passes through the front surface aperture 58.

The yoke 46 is preferably covered with a non-abrasive material, such as an elastomeric pad to prevent scratching of when put in place and removed.

Figure 5:
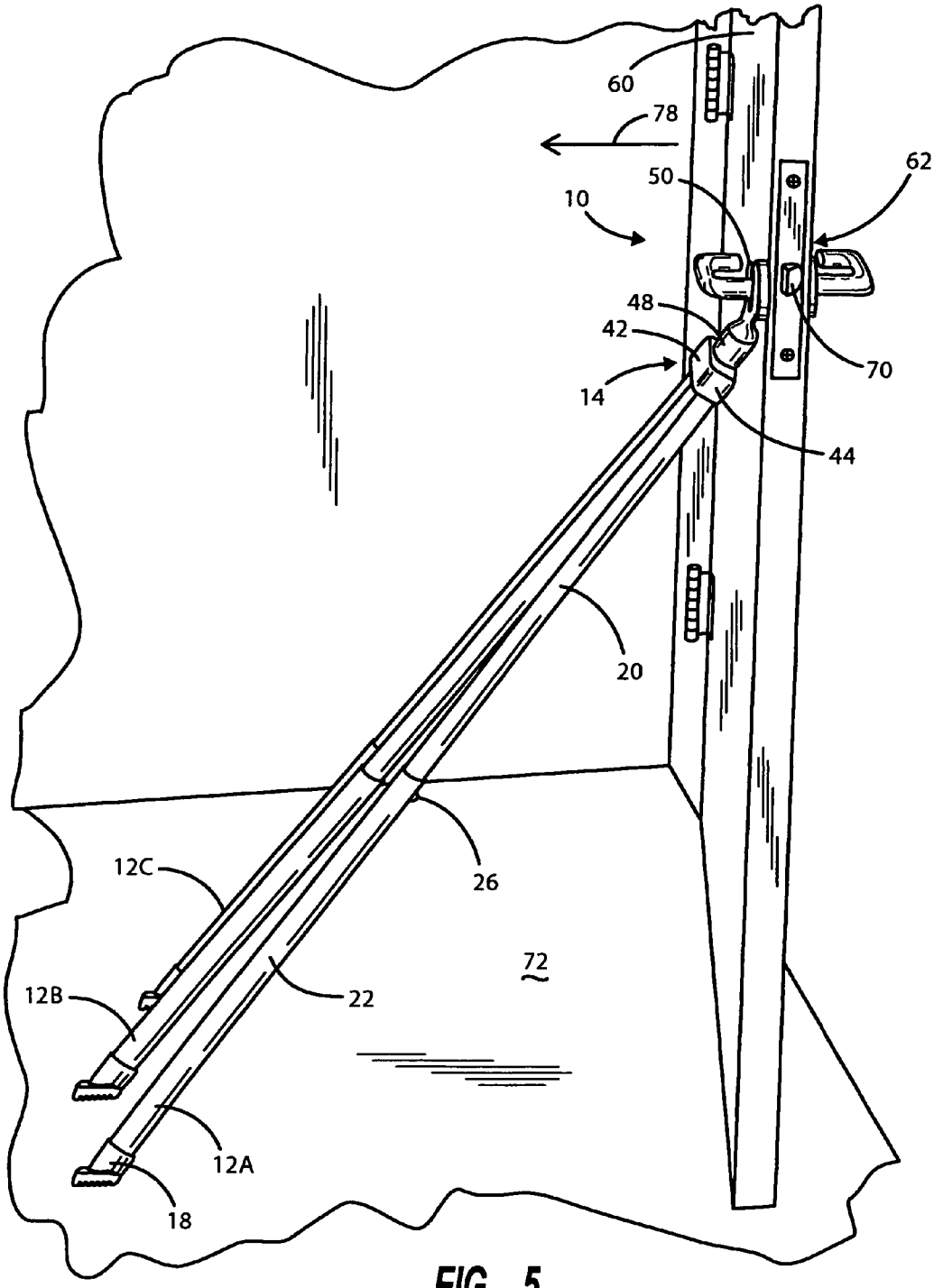
FIG. 5 is a view showing the manner in which the security brace of FIG. 1 is used to prevent forced entry through a room door.

Referring next to FIG. 5, the manner in which the security brace 10 of the present invention is used will be explained. In FIG. 5, there is shown a portion of an entry door 60 in which a lockset is installed. The lockset is indicated generally by numeral 62. The lockset 62 includes a pair of knobs on opposite side surfaces of the door 60. The knobs are operatively coupled to a shaft (not shown) which cooperates with the bolt 70. By turning the knob, the bolt 70 can be retracted free of a socket formed in the adjacent door jam. The floor of the building is identified by the numeral 72.

The security brace 10 is installed by first extending the telescoping segments 20 and 22 of each of the pole members 12*a*, 12*b*, and 12*c*, and locking them together by the bottom detent 26, all as previously described. The block member 14 is operatively coupled to the upper ends 16 of the pole members 12*a*, 12*b*, and 12*c* by the top ball detent 56 as previously described. The semicircular recess 52 formed in the head member 50 is sized to capture the shaft of the lockset 62 to which a door know is secured. When the semicircular recess 52 captures the shaft, the head member 50 rests flat against the side surface 74 of the entry door 60.

When force is applied to the entry door 60 in the direction shown by arrow 76, the vector of force is directed down the pole members 12*a*, 12*b*, and 12*c*, to hold footpads 28 against the floor 72. The downward force vector prevents movement of the brace 10 on the floor 72. This prevents the entry door from swinging open.

This invention has been described herein in considerable detail in order to comply with the Patent Statutes and to provide those skilled in the art with the information needed to apply the novel principles and to construct and used such specialized components as are required. However, it is understood that the invention can be carried out by specifically different equipment and devices, and that various modifications, both as to the equipment details and operating procedures, can be accomplished without departing from the scope of the invention itself.

What is claimed is:

1. An entry door security brace for impeding forced entry into a room through a door, said door having a lockset with a pair of knobs on opposite side surfaces of the doors, the knobs being operatively coupled to a shaft, said brace comprising:

a) a plurality of pole members wherein said pole members include an upper end, and a lower end with a foot member secured to the lower ends of each of said plurality of pole members;

b) a single block member said block member being a solid piece of material in the form of a generally flat-sided parallelepiped having a top planar surface with a yoke extending upward from the top planar surface and a bottom surface having a plurality of circular apertures cut into said bottom surface whereby the pole members are secured to the block members when the upper ends of the pole members pass through the circular aperture and are held in place by a locking member, said yoke receiving said shaft therein; and c) a cylindrical stem extending upwardly from the top surface of said block member, said cylindrical stem fitting into an opening in the bottom of the yoke.

2. The security brace in claim 1 wherein the plurality of pole members each comprise first and second tubular telescoping segments and means for locking said segments relative to one another at a predetermined composite length.

3. The security brace as in claim 1 wherein said foot member includes a non-skid floor engaging surface.

4. The security brace as in claim 3 wherein said non-skid surface is an elastomeric pad.

5. The security brace as in claim 3 wherein said non-skid surface includes a plurality of dominantly projecting corrugations.

6. The security brace as in claim 1 wherein the locking member includes a ball detent disposal proximate the upper end of each pole member and a front surface aperture is cut into a front surface of the block member, wherein when the ball detent passes through the front surface aperture, the pole member is locked into the block member.

7. An entry door security brace for impeding forced entry into a room through a door, said door having a lockset with a pair of knobs on opposite side surfaces of the doors, the knobs being operatively coupled to a shaft, said brace comprising:

a) a plurality of pole members wherein said pole members include an upper end, and lower end with a foot member secured to the lower end of said pole members;

b) a single block member secured to the upper ends of said plurality of pole members, wherein said block member is a solid piece of material in the form of a generally flat-sided parallelepiped having a top planar surface with a yoke member extending upward from the top planar surface, said yoke member adapted to receive said shaft, wherein said yoke member includes a yoke base and a head member, the head member sloping at a predetermined angle to a longitudinal axis of the yoke base and a bottom surface having a plurality of circular apertures cut into the block member wherein the pole members are inserted into the circular slots and held in the block member by a locking member; and c) a cylindrical stem extending upwardly from the top surface of the base member for fitting into an opening in a bottom of the yoke.

8. The security brace as in claim 7 wherein the plurality of pole members each comprise first and second tubular telescoping segments and means for locking said segments relative to one another at a predetermined composite length.

9. The security brace as in claim 7 wherein said foot member includes a non-skid floor engaging surface.

10. The security brace as in claim 9 wherein said non-skid surface is an elastomeric pad.

11. The security brace as in claim 9 wherein said non-skid surface includes a plurality of dominantly projecting corrugations.

12. The security brace as in claim 1 wherein the circular apertures are non-intersecting circular apertures.

13. The security brace as in claim 7 wherein the circular apertures are non-intersecting circular apertures.

14. The security brace as in claim 7 wherein the locking member includes a ball detent disposed proximate the upper end of each pole member and a front surface aperture is cut into a front surface of the block member, wherein when the ball detent passes through the front surface aperture, the pole member is locked into the block member.

* * * * *